US007036685B1

(12) United States Patent
Green

(10) Patent No.: US 7,036,685 B1
(45) Date of Patent: May 2, 2006

(54) MULTI-VALVE DELIVERY SYSTEM

(76) Inventor: Ronald D. Green, 13595 Cable Rd., Pataskala, OH (US) 43062

( * ) Notice: Subject to any disclaimer, the term of this patent is extended or adjusted under 35 U.S.C. 154(b) by 5 days.

(21) Appl. No.: 10/846,075

(22) Filed: May 14, 2004

Related U.S. Application Data

(63) Continuation-in-part of application No. 10/168,121, filed on Jun. 17, 2002, now Pat. No. 6,736,288.

(51) Int. Cl.
*B65D 35/22* (2006.01)

(52) U.S. Cl. ..... 222/94; 222/145.6; 222/386.5; 222/402.19

(58) Field of Classification Search ..... 222/94, 222/95, 136, 145.5, 145.6, 386.5, 402.1, 222/402.19, 459
See application file for complete search history.

(56) References Cited

U.S. PATENT DOCUMENTS 3,521,792 A * 7/1970 Davidson ..... 222/136
3,992,003 A * 11/1976 Visceglia et al. ..... 222/94
5,413,253 A * 5/1995 Simmen ..... 222/137
5,803,319 A * 9/1998 Smith et al. ..... 222/402.19
5,899,362 A * 5/1999 Moran ..... 222/136
6,736,288 B1 * 5/2004 Green ..... 222/94
2004/0226964 A1 * 11/2004 Bourque et al. ..... 222/136

* cited by examiner

*Primary Examiner*—Joseph A. Kaufman
(74) *Attorney, Agent, or Firm*—Richard L Huff

(57) ABSTRACT

The technical field is that of simultaneous dispensing of viscous materials. Many compositions comprise viscous components which must be kept separate until they are used. Known methods of application of separate components do not guarantee proper ratios. This invention solves this problem by presenting a single aerosol container (4) having a multi-valve body (8) wherein the valves (10, 12) are activated by a single actuator (26) and the viscous materials are kept separate until used. The system (2) may use multiple collapsible bags (16), a barrier liner (42), a dip tube (46), and a spray-any-direction valve (50) having an omnidirectional attachment (60) which contains a check valve container (122) made up of a constricted lower end (132), a top surface (134), a lateral opening (136), and a check ball (138) for opening and closing passageways.

5 Claims, 8 Drawing Sheets

MULTI-VALVE DELIVERY SYSTEM

CROSS-REFERENCE TO RELATED APPLICATIONS

This application is a continuation-in-part of my application Ser. No. 10/168,121, filed Jun. 17, 2002, now U.S. Pat. No. 6,736,288.

STATEMENT REGARDING FEDERALLY SPONSORED RESEARCH OR DEVELOPMENT (Not applicable)

REFERENCE TO SEQUENTIAL LISTING, A TABLE, OR A COMPUTER PROGRAM LISTING APPENDIX SUBMITTED ON A COMPACT DISC (Not applicable)

BACKGROUND OF THE INVENTION

1) Field of the Invention

This invention relates to systems for dispensing more than one viscous material from a pressurized aerosol container. The viscous materials are kept separate from each other during storage inside the container. Each viscous material is dispensed through a separate valve. In use, a single actuator activates each of the valves allowing the separate viscous materials to pass out of the container and to be mixed together in a mixing tube.

2) Description of the Related Art

Many viscous products are made up of two or more viscous components which must be mixed, in given proportions, only at the time of application. Mixing of the components prior to the time of application will render many such products useless.

The prior art is aware of dispensing single viscous materials such as resins, sealing compounds, dental compositions, adhesives, paints, and the like from single aerosol containers. Also commonly known are methods of dispensing two viscous materials simultaneously from two separate tubes, cartridges, or aerosol containers. In these systems, two separate containers are necessary.

The prior art is also aware of dispensing two viscous materials contained in two separate aerosol containers shrink-wrapped together and equipped with a common valve actuator that is large enough to span both containers and dispense the two materials simultaneously into a common mixing tube. While this permits the administration of the desired ratios of viscous materials, the container is cumbersome and expensive.

Miczka, in U.S. Pat. No. 5,012,951, discloses a system for dispensing viscous materials from a pressurized container. The system comprises a container which is closed at the bottom by a dome-shaped bulkhead and at the top by a funnel, through which dispensing ports are fitted. Inner containers are pressed to dispense their viscous contents by the internal pressure of the loaded propellant. A venting valve through the funnel controls the dispensing rate. The funnel is made from a thin outer skin, secured to the container by a crimped edge, with inner reinforcing walls to take up the pressure distortion. This device contains two separate dispensing valves with no mention of a mixing tube. The funnel is unique to the container of the above patented device, and is not standard equipment readily available in the art. The valves of this system are separated from each other. Thus, the use of a single actuator would be difficult. No actuator is mentioned by the patent.

As can be seen, a need exists for improvement in simultaneous pressurized dispensing of multiple viscous materials from a single container. The object of the present invention is to provide improvements in this area.

BRIEF SUMMARY OF THE INVENTION

The storage and dispensing system of the present invention fits the presently standard one-inch (2.54 cm) opening in the top of common aerosol containers or it may fit into containers in which the top covers up to the entire top surface of the container. The multi-valve dispensing system of the present invention allows different viscous materials to be simultaneously dispensed in predetermined proportions. As the separate materials are ejected from the multi-valve container, they enter a standard mixing tube for blending so that the final product is a mixed combination of the separate materials contained in the container. For the purposes of the description and claiming of this invention, "viscous" will refer to that property which demonstrates 1–1,000,000 centipoises (cp), preferably 1–500,000 cp.

A key feature of the present invention is a multi-valve. Each multi-valve contains one or more inlet stems which permit the attachment of different devices for storage of different viscous materials. In one arrangement of the present system, one of the inlet stems permits dispensing of the material without the attachment of any devices. Another arrangement allows the viscous material to pass to the valve through a dip tube. In a further arrangement, the viscous material is contained in a collapsible bag having an outlet which is attached directly to the valve inlet.

The multi-valve components are incorporated into a single valve body. In the valve body are two or more standard spring-loaded valve plungers that, when depressed, open valve ports through which the pressurized viscous materials can flow from the container. The size of the valve ports are varied to obtain the desired rate of flow of the dispensed product. The spring-loaded plungers are depressed by manual pressure applied through the valve actuator that fits on top of the valve. The valve plungers can be of the standard "male", "female", or "tilt" type commonly used by the industry. Additionally, the present invention describes a novel omnidirectional check valve which permits the flow of the viscous materials to the multi-valve regardless of the position of the container.

A wide variety of storage and delivery methods is possible in carrying out the present invention. Four possible combinations for storage and delivery of multiple pressurized viscous materials are described in detail in combination with the multi-valve of the present invention. These are:

1. A system using two or more collapsible bags;
2. A system using a barrier liner and one or more collapsible bags;
3. A system using a dip tube and one or more collapsible bags; and
4. A system using a dip tube in combination with one or more collapsible bags with an omnidirectional valve.

DETAILED DESCRIPTION OF THE INVENTION

Figure 1:
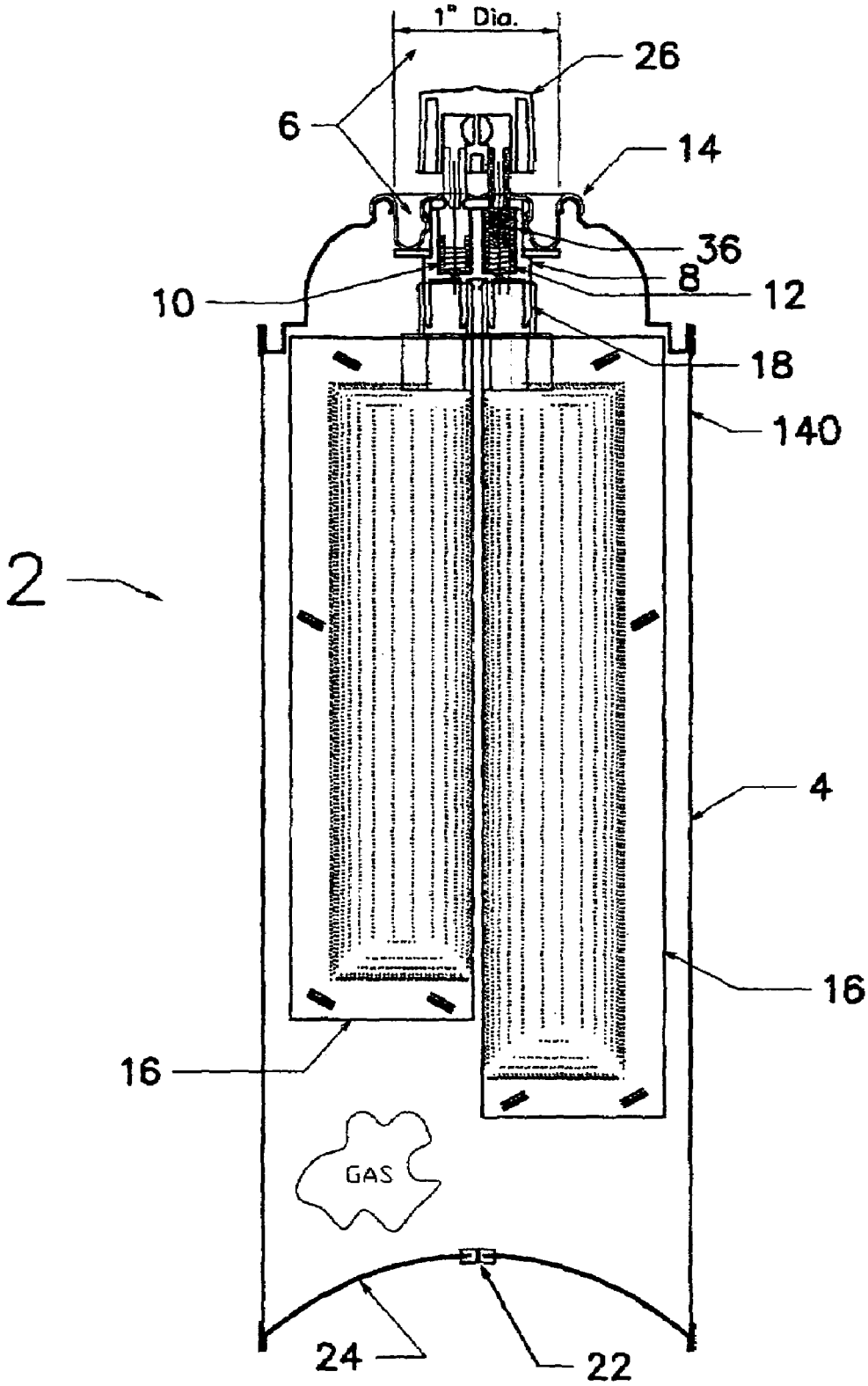
FIG. 1 is a cross-sectional view of a pressurized aerosol container using the multi-valve dispensing system of this invention in combination with a two-bag storage arrangement.

The invention will now be described in detail with reference to the above drawings. Like reference numerals refer to like parts throughout the description.

The storage and dispensing system 2 of this invention is useful for the storing and dispensing of viscous materials which should be kept separate until the time of application. The term "viscous" is intended to be defined as that range of viscosity having 1–1,000,000 cp, preferably 1–500,000 cp throughout the description and claims. Examples of such materials are resins, sealing compounds, dental compositions, adhesives, paints, certain cosmetic hair coloring, and other chemical components that need mixing just prior to application.

The entire system 2 will now be described with reference to FIGS. 1–9.

The storage and dispensing system 2 of the first preferred embodiment of this invention is shown in FIGS. 1 and 5–9. This system 2 is made up of a conventional aerosol container 4 with a conventional one-inch (2.54 cm) diameter top opening 6. The multi-valve body 8 made up of a first valve 10 and a second valve 12 is secured to a sheet metal cup 14 by crimping and collapsible bags 16 for containing viscous materials are attached to the valve stems 18 of each valve 10, 12. In order for the bags 16 to pass through the top opening 6, they are folded, coiled, or otherwise collapsed to a small diameter. The entire assembly of cup 14, multi-valve body 8, and bags 16 is inserted into the container 4 through the top opening 6. The resulting assembly is then sealed and secured to the container 4 by crimping around the perimeter of the cup 14.

The collapsible bags 16 are filled with viscous materials by injecting the materials from the top through the corresponding first 10 and second 12 valves. The pressurizing gas is either injected through a port hole 22 in the cup 14 perimeter or in the bottom 24 of the container 4 or by the "undercup" method. In the "undercup" method a pressurized sleeve fits over the top of the container 4 to force pressurized gas into the container 4 prior to the final sealing around the perimeter of the cup 14. Lastly, the actuator 26 is inserted onto the top of the multi-valve body 8.

A mixing tube 28 is attached by the user to the actuator 26 prior to using the delivery system 2. The length and design of the mixing tube 28 is selected from industry standards to provide adequate mixing of the viscous materials. The mixing tube 28 is discarded after each use. A cap 169 is provided to seal the outlets 32 of the actuator 26 after the mixing tube 28 has been discarded.

The multi-valve outlet openings 30 deliver the separate viscous materials simultaneously from the collapsible bags 16 to the actuator outlet 32. Openings 34 in the spring-loaded valve plungers 36 are sized to deliver, when the actuator 26 is depressed, the proper amounts of each material to the valve outlet openings 30. The viscous materials in the bags 16 are driven out by pressure from the pressurizing gas which surrounds the bags 16. The flow of materials is cut off when the actuator 26 and the plungers 36 are released. Unmixed materials above the cut-off seal 146 at the plungers 36 remain in the actuator 26 but are prevented from mixing with each other or from being affected by contact with the atmosphere by the installation of the cap 169.

The collapsible bags 16 are preferably constructed of foil-reinforced polyethylene, Nylon, aluminum, or other suitable material that will effectively contain the viscous materials but which is still pliable enough to collapse under pressure, like a toothpaste tube, when the corresponding valve 10, 12 is opened.

The storage and dispensing system 2 of this embodiment is adaptable to be used with more than two viscous materials by simply adding additional storage bags 16 to the container 4 and extra valve plungers 36 to the unitary valve body 8 as shown in FIGS. 13–16.

The system 2 of this embodiment is most appropriate for products where the viscous material components are equal, or nearly equal, in quantity.

Figure 2:
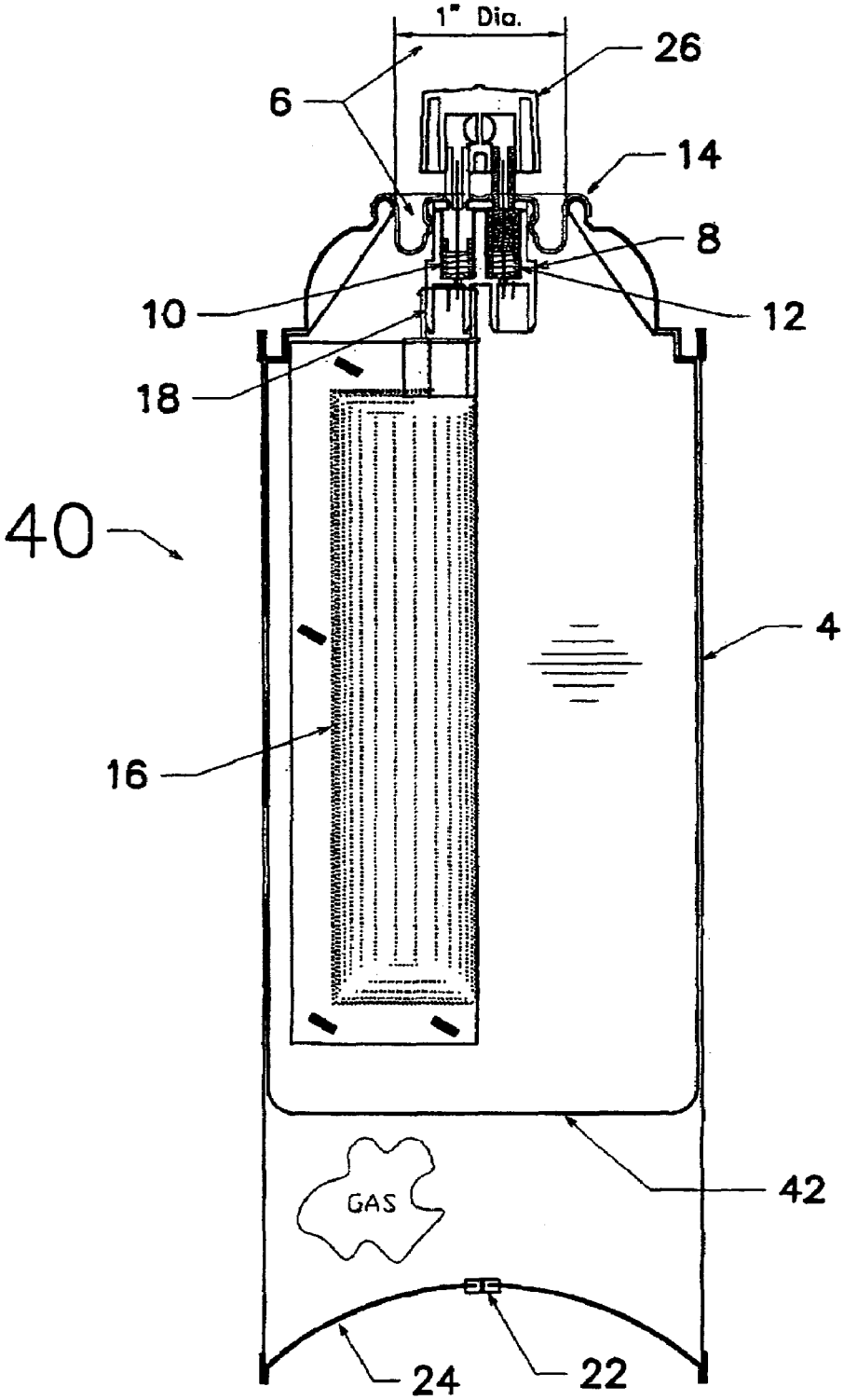
FIG. 2 is a cross-sectional view of a pressurized aerosol container using the multi-valve dispensing system of this invention in combination with a single bag and barrier liner storage arrangement.

The storage and dispensing system 40 of the second preferred embodiment of this invention shown in FIG. 2 is made up of a standard aerosol container 4 with a standard one-inch (2.54 cm) diameter top opening 6 and a pre-installed industry-standard barrier liner 42. The multi-valve body 8 is secured to a cup 14 by crimping and a bag 16 is attached to the valve stem 18. In order for the bag 16 to pass through the top opening 6, it is folded, coiled, or otherwise collapsed to a small diameter. The entire assembly of cup 14, multi-valve body 8, and bag 16 is inserted into the container 4 which contains a pre-installed barrier liner 42 through the top opening 6 of the container 4. The assembly is then sealed and secured to the container 4 by crimping around the inside perimeter of the cup 14.

After the cup 14 is installed and sealed by crimping, the barrier liner 42, in effect, forms a larger bag which completely encloses the smaller collapsible bag 16. The collapsible bag 16 and the barrier liner 42 are both filled by injecting the viscous materials from the top through the corresponding first 10 and second 12 valves. The pressurizing gas is injected through a port hole 22 in the bottom 24 of the container 4 or by the "undercup" method. Finally, the actuator 26 is inserted onto the top of the multi-valve body 8.

As described with reference to the first preferred embodiment, a mixing tube 28 is attached by the user to the actuator 26 prior to using the delivery system 2. A cap 169 is provided to seal the outlets 32 of the actuator 26 after the mixing tube 28 is discarded.

The multi-valve body 8 of the second preferred embodiment delivers two or more viscous materials simultaneously from the collapsible bag 16 and from within the barrier liner 42. The multi-valve inlet openings 34 in the valve body 8 are sized to deliver, when the actuator 26 is depressed, the proper proportions of each material to the valve plungers 36. The viscous materials in the bag 16 and within the barrier liner 42 are driven out of the container 4 by pressure from the pressurizing gas which surrounds them. The flow of viscous materials is stopped when the plungers 36 are released. Unmixed materials above the cut-off seal 146 of the plungers 36 remain in the actuator 26, but are prevented from mixing with each other or from being affected by contact with the atmosphere by the installation of the cap 169.

The collapsible bag 16 is preferably constructed of foil-reinforced polyethylene, Nylon, aluminum, or other suitable material that will effectively contain the viscous material but which is still pliable enough to collapse under pressure, like a toothpaste tube, when the valve 10 is opened.

Figure 15:
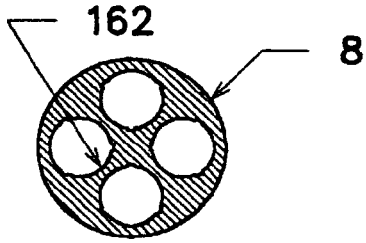
FIG. 15 is a plan view of a valve body containing four valves.
Figure 13:
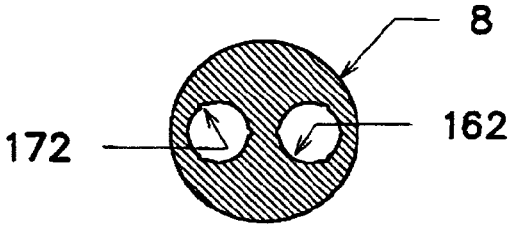
FIG. 13 is a plan view of a valve body containing two valves.
Figure 16:
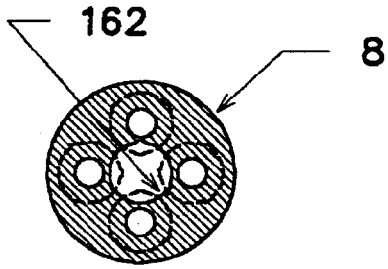
FIG. 16 is a plan view of a valve body containing five valves.
Figure 14:
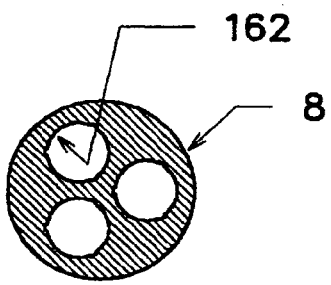
FIG. 14 is a plan view of a valve body containing three valves.

The storage and dispensing system 40 of the second preferred embodiment is adaptable to be used with more than two viscous materials by simply adding additional collapsible bags 16 inside the barrier liner 42 and additional valve plungers 36 to the multi-valve body 8, as shown in FIGS. 14–16.

The storage and dispensing system 40 of the second preferred embodiment is appropriate for products where two or more viscous material components, such as epoxy resin and its catalyst(s), are mixed in significantly unequal proportions. The smaller amount of the viscous material is stored in the interior collapsible bag(s) 16. The larger amount of viscous material is stored in the space bounded by the barrier liner 42.

Figure 3:
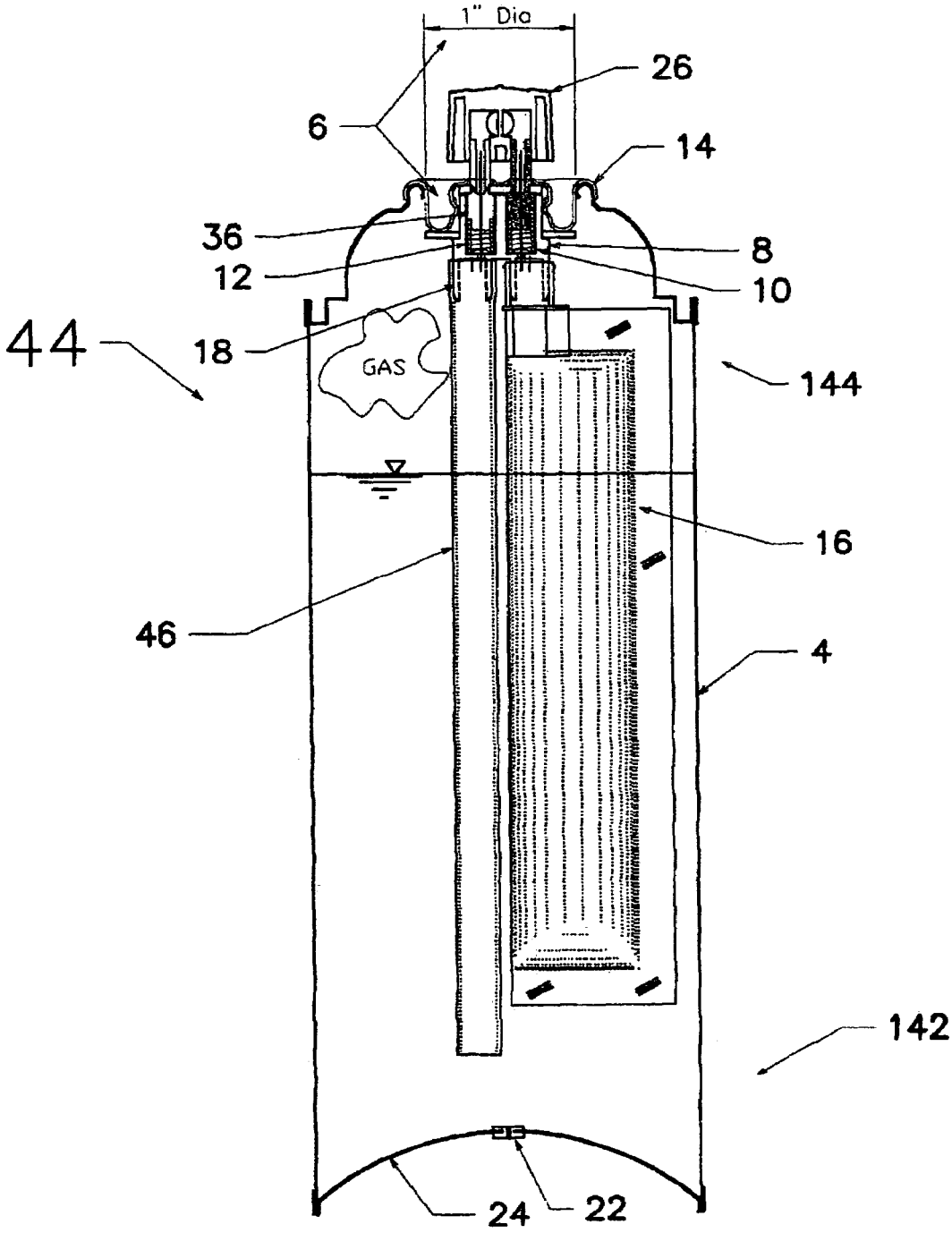
FIG. 3 is a cross-sectional view of an upright pressurized aerosol container using the multi-valve dispensing system of this invention in combination with a single bag and dip tube arrangement. The dip tube reclaims material from the bottom of the container.

The storage and dispensing system 44 of the third preferred embodiment of this invention as shown in FIG. 3 is made up of a standard aerosol container 4 having a standard one-inch (2.54 cm) diameter top opening 6. The multi-valve body 8 is secured to a cup 14 by crimping, and a collapsible bag 16 and an industry-standard dip tube 46 are attached to the first 10 and second 12 valve inlets 18. In order for the collapsible bag 16 to pass through the top opening 6, it is folded, coiled or otherwise collapsed to a small diameter. The entire assembly of cup 14, multi-valve body 8, collapsible bag 16, and dip tube 46 is inserted into the container 4 through the top opening 6. The assembly is then sealed and secured to the container 4 by crimping around the perimeter of the cup 14.

The collapsible bag 16 and the space surrounding the dip tube 46 are then filled by injecting the viscous materials through the corresponding valves 10, 12 in the multi-valve body 8. The pressurizing gas is injected through the port hole 22 in the perimeter of the cup 14 or in the bottom 24 of the container 4 or by the "undercup" method. Lastly, the actuator 26 is inserted onto the top of the multi-valve body 8.

A mixing tube 28 is attached by the user to the actuator 26 prior to using the delivery system 44. The length and design of the mixing tube 28 is selected from industry standards to provide adequate mixing of the viscous materials. The mixing tube 28 is discarded after each use. A cap 169 is provided to seal the outlet passageway 32 of the actuator 26 after the mixing tube 28 has been discarded.

The multi-valve inlet openings 34 deliver two or more viscous materials simultaneously from the collapsible bag 16 and dip tube 46 which reaches from the bottom 24 of the container 4 to the multi-valve inlet 18.

The multi-valve inlet openings 34 in the valve bodies 8 are sized to deliver, when the actuator 26 is depressed, the proper proportions of each material to valve plungers 36. The viscous materials in the bag 16 and at the bottom 24 of the container 4 are driven out of the container 4 by pressure from the pressurizing gas which acts upon them. The flow of viscous materials is stopped when the plungers 36 are released. Unmixed materials above the cut-off 146 of the plungers 36 remain in the actuator 26, but are prevented from mixing with each other or from being affected by contact with the atmosphere by the installation of the cap 169.

The collapsible bag 16 is preferably constructed of foil-reinforced polyethylene, Nylon, aluminum, or other suitable material that will effectively contain the viscous materials but which is still pliable enough to collapse under pressure, like a toothpaste tube, when the associated valve 10 is opened.

The storage and dispensing system 44 of this embodiment, which is adaptable to be used with more than two viscous materials by simply adding additional storage bags 16 to the container 4 and extra valve plungers 36 to the multi-valve body 8, is shown in FIGS. 14–16.

The system 44 of this embodiment is most appropriate for products like sputter paint where a thinner viscous material needs to be mixed with one or more thicker, but smaller quantity, viscous material as it is delivered. In such a case, the length of the mixing tube 28 is selected to allow the mixed product to be delivered as a spray.

It has been determined that in the spraying of paint, adhesives, and undercoatings from pressurized aerosol containers, the use of a male valve is inappropriate as male valves demonstrate a tendency to clog or plug, thereby rendering the aerosol container inoperative. The use of female valves for polymers has, until now, been limited to containers which are held upright. Such valves are less than ideal for the task of connecting plastic pipe, for instance, as this task requires the aerosol container to be usable in the inverted position in tight quarters. Until now, an omnidirectional female valve has not been available to the art, and this has required physical gyrations by the user if anything other than surfaces easily sprayed by an upright container needed to be sprayed.

Figure 4:
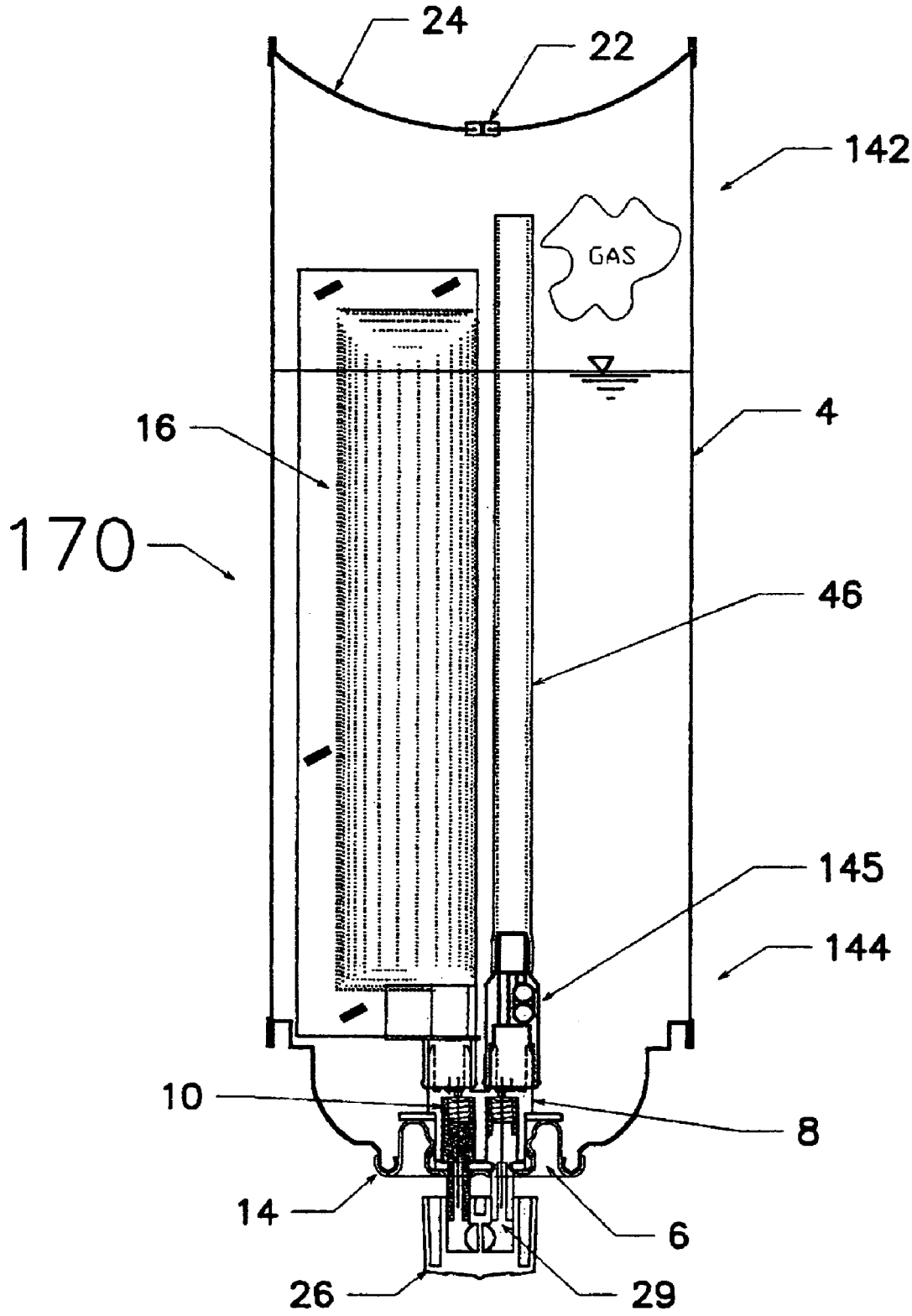
FIG. 4 is a cross-sectional view of an inverted pressurized aerosol container using the multi-valve dispensing system of this invention with a single bag and dip tube arrangement in combination with a spray-any-direction (SA) check valve.
Figure 5:
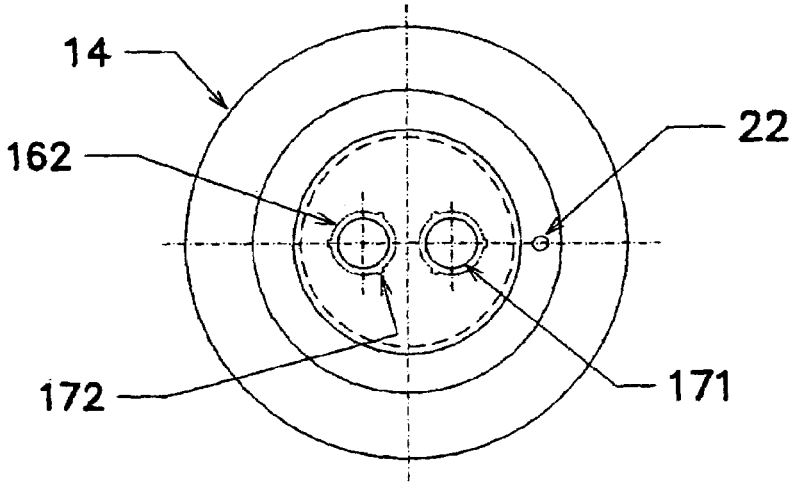
FIG. 5 is a plan view of the multi-valve dispenser utilizing two valves.
Figure 7:
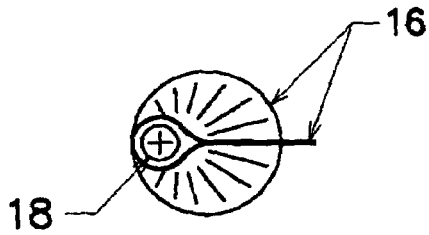
FIG. 7 is a plan view of a bag used for storage of materials in this invention.
Figure 10:
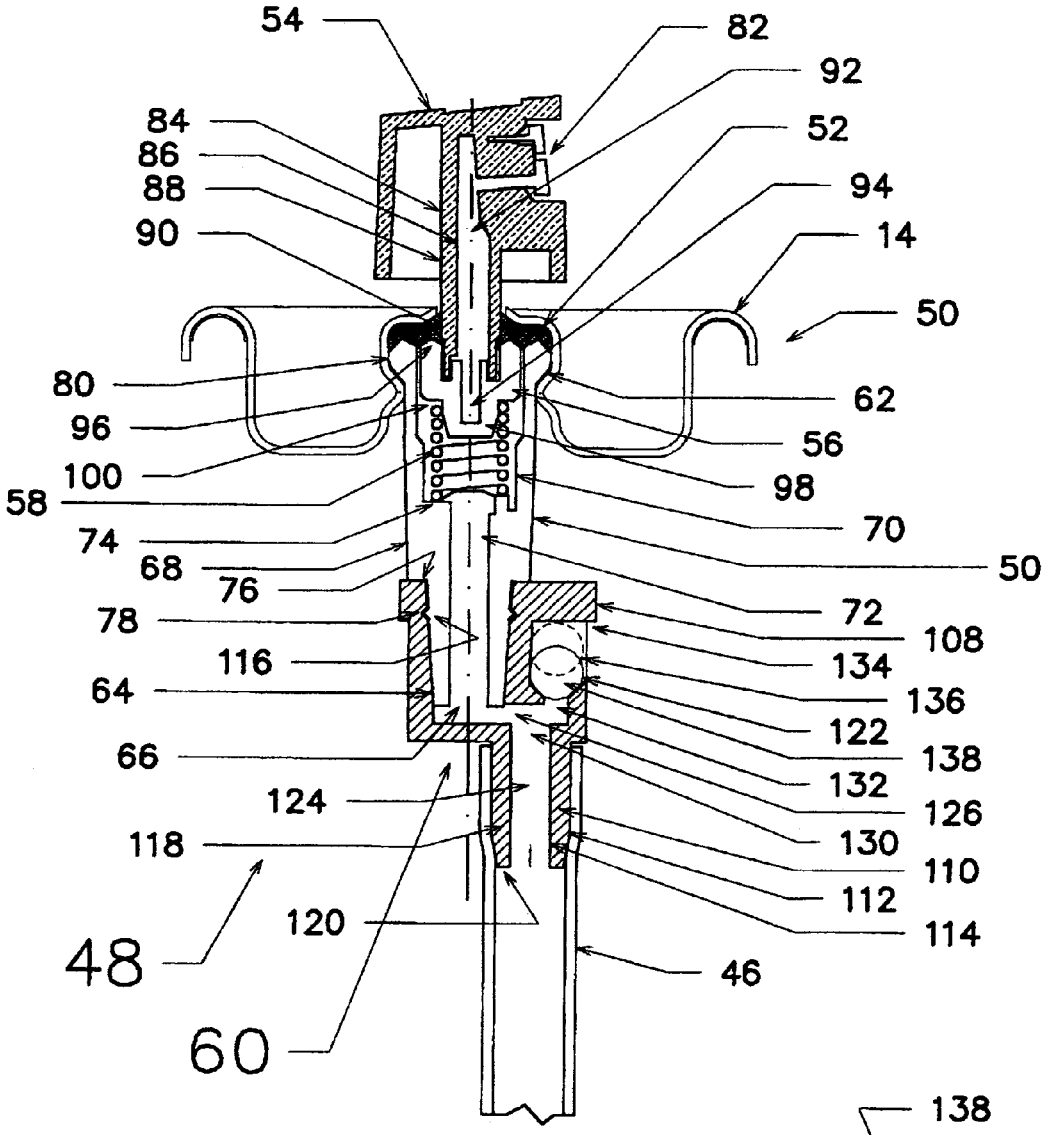
FIG. 10 is a side cross-sectional view of the omnidirectional valve of the present invention attached to the multi-valve and to a dip tube.
Figure 11:
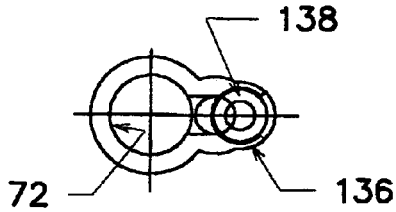
FIG. 11 is a cross-sectional plan view taken through the steel ball retainer of the omnidirectional valve of FIG. 10.
Figure 12:
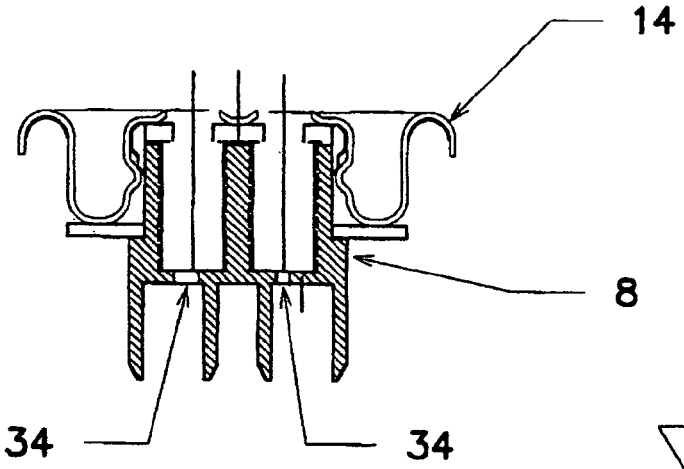
FIG. 12 is a front cross-sectional view of the multi-valve body of the present invention seated in a cup.

Part of the present invention is the description of an omnidirectional female valve 48 for use as one of the valves 10, 12 in a system 44 requiring a dip tube 46, which system 44 will be inverted during use as in FIG. 4. This valve 48 may be more readily understood with reference to FIGS. 10 and 11. Reference is also made to FIG. 1 for features of the container. For ready understandability, FIG. 10 shows only the novel female omnidirectional valve 48 of the present invention and does not show the first 10, conventional, valve of the multi-valve system 44.

The novel valve 48 comprises a valve body 50, a valve seal 52, an actuator 54, a valve plunger 56, a compression spring 58, and an omnidirectional attachment 60.

The valve body 50 is constructed of suitable thermoplastic resins or Nylon and is generally cup-shaped. The valve body 50 has a thickened top rim 62 surrounded by castellations. The valve body 50 further contains a lower end 64 having a central intake opening 66, an exterior surface 68, an interior cup-shaped opening 70, an internal passageway 72 extending from the lower end 64 to the cup-shaped opening 70, an internal shoulder 74, an external shoulder 76, and an exterior ridge 78.

The valve seal 52, preferably made of rubber, fits across the top rim 62 of the valve body 50 and is held between the valve body 50 and the interior surface 80 of a modified cup 14 by crimping around the castellations of the valve body 50. The valve seal 52 assures a permanent tight fit between the interior surface 80 of the cup 14 and the top rim 62 of the valve body 50. The cup 14 is of such a size as to fit the standard one-inch (2.54 cm) hole in aerosol containers 4.

The actuator 54 is located above the valve body 50 and mounts on the valve plunger 56. The actuator 54 contains an outlet orifice 82 and a vertical stem 84 having inner 86 and outer 88 surfaces, an inlet orifice (not shown) commonly in the form of a slit between the inner 86 and outer 88 surfaces of the stem 84, a lower end 90, and a passageway 92 for the viscous material.

The valve plunger 56 contains an open cup 94 having an upper surface 96 for holding the lower end 90 of the actuator 54, a closed bottom 98 which fits inside the compression spring 58, and a lower shoulder 100 for abutting with the compression spring 58. The valve plunger 56 is slidably held in the cup-shaped opening 70 of the valve body 50.

The compression spring 58 has an upper end which abuts with the lower shoulder 100 of the valve plunger 56 and a lower end which abuts with the internal shoulder 74 of the valve body 50. When there is no downward pressure on the actuator 54, the spring 58 tends to force the valve plunger 56 upwardly against the valve seal 52, thus preventing escape of the contents from the container 4. When there is a downward pressure on the actuator 54, the valve plunger 56 is forced downwardly and a space develops between the valve seal 52 and the upper surface 96 of the valve plunger cup 94, and the contents of the container 4 are allowed to escape through the inlet orifice (not shown) into the stem 84 of the actuator 54.

The omnidirectional attachment 60 contains a top 108 which abuts against the external shoulder 76 of the valve body 50, side walls 110 having exterior 112 and interior 114 surfaces, the side walls 110 having a notch 116 on the interior surface 114, a hollow lower stem 118 having a lower end 120, and a check valve container 122.

The lower stem 118 fits into a dip tube 46 which extends from the lower stem 118 to the bottom 24 of the container 4. The lower stem 118 contains a lower vertical passageway 124 and lateral passageway 126 through which the viscous material passes when the container 4 is in the upright position. The lateral passageway 126 leads from the upper end 130 of the lower passageway 124 in the lower stem 118 to the central intake opening 66 of the valve body 50.

The top 108 of the omnidirectional attachment 60 is held permanently in place to the valve body 50 by a snap-on connection between the external ridge 78 of the valve body 50 and the notch 116 on the interior surface 114 of the side wall 110 of the omnidirectional attachment 60.

The check valve container 122 contains an open, but constricted, lower end 132 joining the lateral passageway 126, a top surface 134, a lateral opening 136, and a check ball 138.

The operation of the omnidirectional valve 48 will now be described with reference to FIG. 10. In this description, the term "upright position" refers to any position of the container 4 which allows the check ball 138 to close the constricted lower end 132 of the check valve container 122, the term "inverted position" refers to any position which allows the check ball 138 of the check valve container 122 to open the constricted lower end 132 of the check valve container 122 and allow passage of viscous material through the lateral opening 136 into the lateral passageway 126, the term "upper end 144 of the container 4" refers to that end closest to the actuator 54, and the term "lower end 142 of the container 4" refers to that end farthest from the actuator 54.

When the container 4 is in the upright position or the inverted position, and the actuator 54 is not depressed, no viscous material will flow from the container 4 through the actuator 54.

When the container 4 is in the upright position, the viscous material inside the container 4 is at the lower end 142 of the container 4 and the pressurizing gas is in the upper end 144 of the container 4. If the actuator 54 is depressed, the viscous material is forced up the dip tube 46, into the lower passageway 124 in the stem 118 of the omnidirectional valve attachment 60, through the lateral passageway 126, through the internal passageway 72 of the valve body 50, around the valve plunger 56, through the inlet orifice (not shown) of the actuator 54, through the passageway 92 of the stem 84 of the actuator 54, and out the outlet orifice 82 of the actuator 54. Commonly, the viscous material combines in the mixing tube 28 with other viscous material being forced from the other actuator outlet opening 30. In this case, the viscous material does not enter the check valve container 122 as the check ball 138 seals off the constricted lower end 132 thereof.

When the container 4 is in the inverted position, the viscous material inside the container 4 is at the upper end 144 of the container 4 and the pressurizing gas is in the lower end 142 of the container 4. In this position, the check ball 138 (shown dashed) lies against the top surface 134 of the check valve container 122 allowing flow of viscous material from the upper end 144 of the container 4 into the lateral passageway 126 of the omnidirectional attachment 60. If the actuator 54 is depressed, the viscous material is forced by the pressurizing gas through the lateral opening 136 into the check valve container 122, past the check ball 138, through the lateral passageway 126, through the internal passageway 72 of the valve body 50, around the valve plunger 56, through the inlet orifice (not shown) of the actuator 54, through the passageway 92 of the actuator 54, and out the outlet orifice 82 of the actuator 54. Commonly, the viscous material combines in the mixing tube 28 with other viscous material being forced from the other actuator outlet opening 30. In this case, the pressurizing gas does not enter the internal passageway 72 of the valve body 50 as the viscous material seals off the lateral passageway 126.

The storage and dispensing system 170 of the fourth preferred embodiment of this invention will now be described with reference to FIG. 4. The storing and dispensing system 170 of this embodiment is made up of a standard aerosol container 4 with a standard one-inch (2.54 cm) diameter top opening 6. In this embodiment, a bag 16 is attached to one inlet 18 of the multi-valve body 8 and a standard SA valve 145 and dip tube 46 is attached to the other inlet 18. (If the valve(s) incorporated in the multi-valve body 8 are "female" valves, the standard SA valve 145 is appropriately replaced with the novel omnidirectional valve attachment 60 of this invention.) The multi-valve body 8 is secured to a cup 14 by crimping and a collapsible bag 16 and dip tube 46 are attached to the valve body 8. In order for the collapsible bag 16 to pass through the top opening 6, it is folded, coiled, or otherwise collapsed to a small diameter. The entire assembly of cup 14, multi-valve body 8, collapsible bag 16, and dip tube 46 is inserted into the container 4 through the top opening 6. The assembly is then sealed and secured to the container 4 by crimping around the inside perimeter of the cup 14.

The collapsible bag 16 and the space surrounding the dip tube 46 are then filled by injecting the viscous materials through the top opening 6 through the corresponding valves 10, 145 and the pressurizing gas is injected through the port hole 22 in the perimeter of the cup 14 or in the bottom 24 of the container 4 or by the "undercup" method. Lastly, the actuator 26 is inserted onto the top of the multi-valve body 8.

When the container 4 is inverted as shown in FIG. 4, the multi-valve body 8 delivers viscous materials simultaneously from the collapsible bag 16 and the SA valve which is now submerged in viscous material. The viscous fluid in the SA valve prevents pressurizing gas from entering the SA valve when the container 4 is inverted so that pressurizing gas cannot escape through the dip tube 46.

Figure 6:
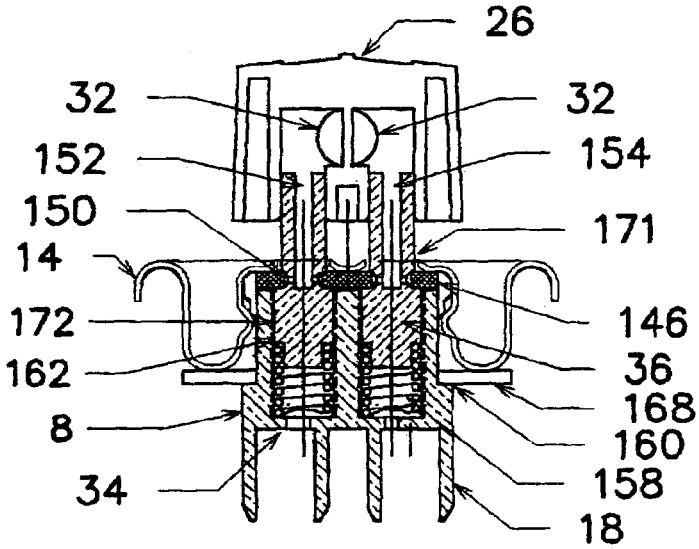
FIG. 6 is a front cross-sectional view of the multi-valve dispenser utilizing two valves.
Figure 8:
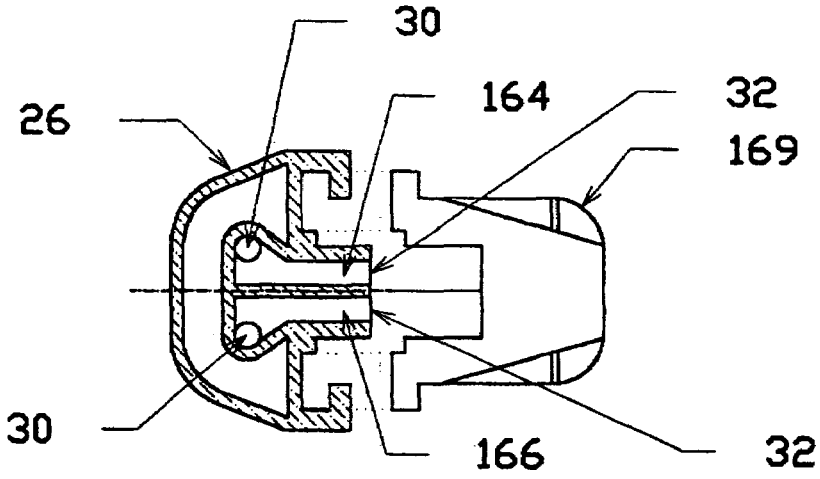
FIG. 8 is a top cross-sectional view, partially exploded, of the actuator for the multi-valve showing the cap for sealing the actuator outlets after use.
Figure 9:
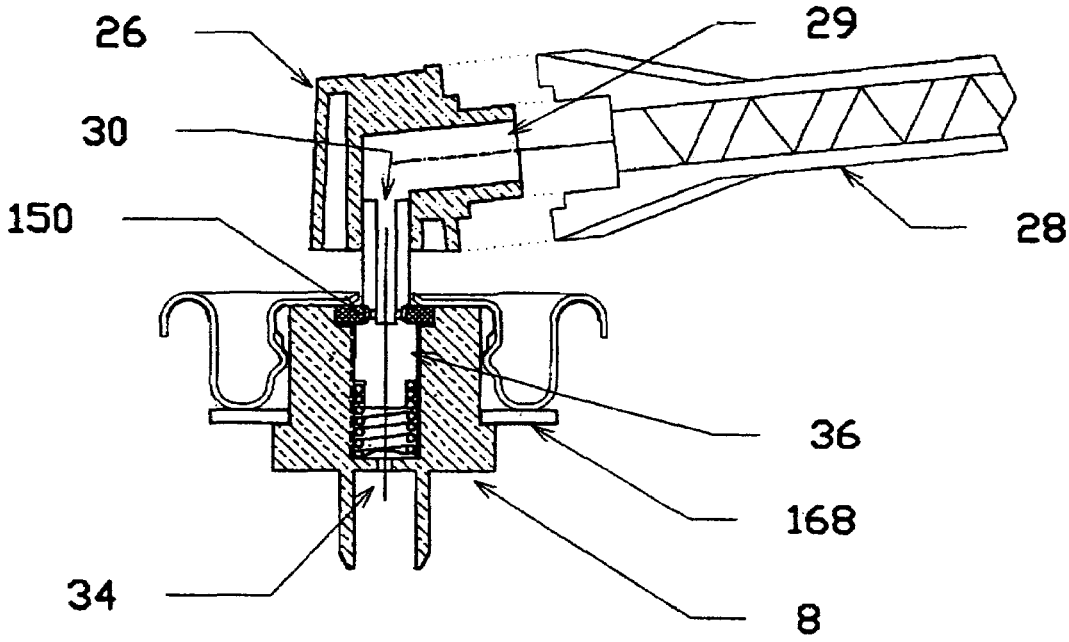
FIG. 9 is a side cross-sectional view, partially exploded, of the multi-valve and actuator to which the mixing tube is attached.

The relative size of the central inlet orifices 34 of the central inlet opening 66 of the valve body 50 is sized to deliver the proper proportions of the viscous material to the valve plungers 36 as shown in FIG. 6. The viscous material in the bag 16 and in the container 4 are driven out by pressure from the pressurizing gas which acts upon them. The flow of materials is cut off when the plungers 36 are released.

The collapsible bag 16 is preferably constructed of foil-reinforced polyethylene, Nylon, aluminum, or other suitable material that will effectively contain the viscous materials but which is still pliable enough to collapse under pressure, like a toothpaste tube, when the first valve 10 in the multi-valve body 8 is opened.

The storage and dispensing system 170 of this embodiment is adaptable to be used with more than two viscous materials by simply adding additional collapsible bags 16 to the container 4 and a comparable number of additional valves 10 to the multi-valve body 8.

This preferred embodiment of the invention is appropriate for products where the aerosol container 4 must be operable from either the normal or inverted position and a thinner viscous material needs to be mixed with a thicker, but smaller quantity, of viscous material as it is delivered.

The details of the multi-valve body 8 of the present invention will be described with reference to FIGS. 5, 6, 8, 9, and 12–16. Reference is also made to FIG. 1 for details of the container.

These Figures show details of a multi-valve body 8 utilizing a typical "male" spring-loaded valve plunger 36. "Female" and "tilt" spring-loaded valve plungers are used in a similar manner. The valve body 8 contains multi-valve stems 18 and valve plungers 36. The valve body 8 is of such a size and shape as to fit into a cup 14 which, in turn, fits into the standard one-inch (2.54 cm) top opening 6 in the container 4. In this way, a conventional aerosol container 4 may be used. Therefore the multi-valve body 8 of this invention may be incorporated cheaply and easily into already existing containers.

Each type of valve plunger 36 is appropriate for different applications of the multi-valve body 8. The various multi-valve body 8 types can be used with a variety of different types and arrangements of spring-loaded valve plungers 36, actuators 26, mixing tubes 28, and sealing caps 169.

With reference to FIGS. 5, 6, 8, 9, and 12–16, the multi-valve body 8 comprises a body constructed of suitable thermoplastic resins or Nylon. The body 8 in plan view is circular in shape and is formed with two or more cylindrical holes 162 to accept multiple spring-loaded valve plungers 36. The plungers 36 extend upward through the holes 171 in the cup 14 and into the bottom of the actuator 26.

Immediately below the opening 171 in the cup 14, a rubber washer or seal 146 is fitted over plunger 36. The seal 146 covers horizontal orifices 150 which pass horizontally through the wall 152 of the passageway 154 of the plunger 36. When the spring-loaded valve plunger 36 is depressed by way of the actuator 26, the rubber seal 146 tilts slightly, thereby exposing the horizontal orifices 150 to allow viscous material to pass from the container 4 to the passageway 154 of the plunger 36 and up into the actuator 26.

The viscous material flows past the plunger 36 by way of vertical grooves 172 in the side of the valve body 8 in which the plunger 36 fits. The viscous material is forced by the pressurizing gas up from the container 4 through the valve inlet openings 34, through the spring 158, and into the grooves 172.

The relative proportions of the viscous materials delivered to the actuator 26 is controlled by the relative size of the inlet orifices 34.

The actuator 26 is formed of thermoplastic resins, Nylon, or other suitable material with independent passages 30, 32 through which viscous materials can flow without touching each other or mixing until they exit the actuator 26. The actuator 26 is formed with force-fit or screw or a locking ring which receives the mixing tube 28 as it is pushed or screwed or twist-locked into position. After the mixing tube 28 is removed, a seal cap 169 can be pushed or screwed or twist-locked into position to seal the outlet openings 32.

The multi-valve body 8 is formed with a perimeter ledge 160 to retain the rubber flap seal 168 and keep the seal 168 tight against the bottom of the cup 14. The flap seal 168 is necessary to seal pressurizing gas from escaping after it is injected through a port hole 22 into the container 4.

FIGS. 13–16 show typical plan views of different multi-valve bodies 8 utilizing the multiple spring-loaded valve plungers 36 to deliver more than two viscous materials from the container to the mixing tube 28.

Although the invention has been described and illustrated in detail, it is to be clearly understood that the same is by way of illustration and example, and is not to be taken by way of limitation. The spirit and scope of the present invention are to be limited only by the terms of the appended claims.

The invention claimed is:

1. A delivery system for viscous materials comprising a pressurized aerosol container containing a cup, a bottom, a multi-valve body comprising at least two valves having internal passageways, a single actuator which activates at least a first valve and a second valve, a pressurizing gas, a first viscous material, and a second viscous material separated from the first viscous material.

2. The system of claim 1 wherein the first and second valves are joined together forming a multi-body, which body contains a shoulder, and which shoulder abuts with a flap ring seal.

3. The system of claim 1, further containing a mixing tube attached to the actuator.

4. The system of claim 1 wherein the first valve is connected to a collapsible bag containing a first viscous material and the second valve is connected to a dip tube extending to near the bottom of the container, the pressurizing gas and the second viscous material occupy the remaining available space in the aerosol container.

5. The system of claim 4 wherein the second valve is connected to a spray-any-direction check valve.

* * * * *

UNITED STATES PATENT AND TRADEMARK OFFICE

CERTIFICATE OF CORRECTION

PATENT NO. : 7,036,685 B1
APPLICATION NO. : 10/846076
DATED : May 2, 2006
INVENTOR(S) : Green It is certified that error appears in the above-identified patent and that said Letters Patent is hereby corrected as shown below:

Col. 10, lines 57 - thru col. 12, line 4

Cancel present claims 1-5.
Insert new claims 1-5 as follows:

1.A delivery system for viscous materials comprising a pressurized aerosol container containing a cup, a bottom, a multi-valve body comprising at least two valves having internal passageways, a single actuator which activates at least a first valve and a second valve, a pressurizing gas, a first viscous material, and a second viscous material separated from the first viscous material wherein the first and second viscous materials are in first and second collapsible bags having sides and the collapsible bags are configured with offset openings which closely approach the sides.
2. The system of claim 1 wherein the first and second valves are joined together forming a multi-body, which body contains a shoulder, and which shoulder abuts with a flap ring seal.
3. The system of claim 1, further containing a mixing tube attached to the actuator.
4. A delivery system for viscous materials comprising a pressurized aerosol container containing a cup, a bottom, a multi-valve body comprising at least two valves having
5.internal passageways, a single actuator which activates at least a first valve and a second valve, a pressurizing gas, a first viscous material, and a second viscous material separated from the first viscous material wherein the first valve is connected to a collapsible bag
6.containing a first viscous material and the second valve is connected to a dip tube
7.extending to near the bottom of the container, the pressurizing gas and the second viscous material occupy the remaining available space in the aerosol container.
5. The system of claim 4 wherein the second valve is connected to a spray-any-direction check valve.

Signed and Sealed this

First Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 7,036,685 B1
APPLICATION NO. : 10/846075
DATED : May 2, 2006
INVENTOR(S) : Green It is certified that error appears in the above-identified patent and that said Letters Patent is hereby corrected as shown below:

Col. 10, lines 57 - thru col. 12, line 4

Cancel present claims 1-5.
Insert new claims 1-5 as follows:

1.A delivery system for viscous materials comprising a pressurized aerosol container containing a cup, a bottom, a multi-valve body comprising at least two valves having internal passageways, a single actuator which activates at least a first valve and a second valve, a pressurizing gas, a first viscous material, and a second viscous material separated from the first viscous material wherein the first and second viscous materials are in first and second collapsible bags having sides and the collapsible bags are configured with offset openings which closely approach the sides.
2. The system of claim 1 wherein the first and second valves are joined together forming a nulti-body, which body contains a shoulder, and which shoulder abuts with a flap ring seal.
3. The system of claim 1, further containing a mixing tube attached to the actuator.
4. A delivery system for viscous materials comprising a pressurized aerosol container containing a cup, a bottom, a multi-valve body comprising at least two valves having
5.internal passageways, a single actuator which activates at least a first valve and a second valve, a pressurizing gas, a first viscous material, and a second viscous material separated from the first viscous material wherein the first valve is connected to a collapsible bag
6.containing a first viscous material and the second valve is connected to a dip tube
7.extending to near the bottom of the container, the pressurizing gas and the second viscous material occupy the remaining available space in the aerosol container.
5. The system of claim 4 wherein the second valve is connected to a spray-any-direction check valve This certificate supersedes Certificate of Correction issued August 1, 2006

Signed and Sealed this

Twelfth Day of September, 2006

JON W. DUDAS
*Director of the United States Patent and Trademark Office*